US005762510A

United States Patent [19]

Taniguchi et al.

[11] Patent Number: 5,762,510

[45] Date of Patent: Jun. 9, 1998

[54] DUSTPROOF CONNECTOR AND DUSTPROOF ENCODER

[75] Inventors: Mitsuyuki Taniguchi; Yoshihito Tanabe; Masao Aochi, all of Oshino-mura, Japan

[73] Assignee: Fanuc, Ltd.

[21] Appl. No.: 865,123

[22] Filed: May 30, 1997

Related U.S. Application Data

[63] Continuation of Ser. No. 512,929, Aug. 9, 1995, abandoned.

[30] Foreign Application Priority Data

Aug. 25, 1994 [JP] Japan ..... 6-201044

[51] Int. Cl.[6] ..... H01R 13/52

[52] U.S. Cl. ..... 439/271; 439/283

[58] Field of Search ..... 439/271, 278, 439/135, 559

[56] References Cited

U.S. PATENT DOCUMENTS

| | | | |
|---|---|---|---|
| 4,090,030 | 5/1978 | Lagasse | 439/559 |
| 4,758,536 | 7/1988 | Miller et al. | 439/138 |
| 4,767,350 | 8/1988 | Cooper et al. | 439/559 |
| 5,139,431 | 8/1992 | Saitoh et al. | 439/559 |
| 5,240,431 | 8/1993 | Yagi et al. | 439/283 |
| 5,254,013 | 10/1993 | Tanaka | 439/282 |
| 5,304,073 | 4/1994 | Golobay et al. | 439/282 |

FOREIGN PATENT DOCUMENTS

| | | | |
|---|---|---|---|
| 1406037 | 9/1975 | United Kingdom | 439/559 |
| 1590478 | 6/1981 | United Kingdom | 439/559 |

*Primary Examiner*—Gary F. Paumen
*Assistant Examiner*—Brian J. Biggi
*Attorney, Agent, or Firm*—Staas & Halsey

[57] ABSTRACT

A dustproof type connector comprising a male member 41 having male contact pins 42 and one recess or projection 43 on the internal surface thereof, a female member 44 having a dustproof packing stopper cap 46 on the top thereof, having female contacts 45 which are connected with the male contact pins 42 and which are connected with a pull-out cable which penetrates the dustproof packing stopper cap 46, and having one projection or recess 47 on the external surface thereof to link with the projection or recess 43 of the male member 41, and a dustproof packing 48 having the internal diameter slightly larger than the external diameter of the male member 41 and the external diameter larger than the external diameter of the dustproof packing stopper cap 46, and a dustproof type encoder which employs the dustproof connenctor of this invention.

2 Claims, 4 Drawing Sheets

DUSTPROOF CONNECTOR AND DUSTPROOF ENCODER

This application is a continuation of application Ser. No. 08/512,929, filed Aug. 9, 1995, now abandoned.

FIELD OF THE INVENTION

This invention relates to an improvement applicable to a dustproof type connector which is employable for connection of an electronic apparatus such as a printed board and the like and to an improvement applicable to a dustproof type encoder which employs the foregoing dustproof type connector. More specifically, this invention relates to an improvement developed for simplifying the procedure to apply dustproof structure to the location at which a cable penetrates the cover of an electronic unit such as an encoder and the like.

BACKGROUND OF THE INVENTION

Application of dustproof structure is desirable for an electronic unit such as an encoder and the like which are employable for a servomotor, a machine tool, a measuring instrument, and the like.

The side view and the sectional front view of an encoder covered by a dustproof type cover and which is available in the prior art are illustrated respectively in FIGS. 1 and 2.

Referring to FIGS. 1 and 2, an encoder flange 1 which is an encoder proper and which houses a rotating member which is rotated from outside through a coupling 6, is mounted by a printed board 3. One surface of the encoder flange 1 is covered by an encoder cover 2, and the other surface of the encoder flange 1 is covered by an encoder back cover (unnumbered). A cover packing 21 is provided between the encoder flange 1 and the encoder cover 2 and an O ring 11 is provided between the encoder flange 1 and the encoder back cover. An encoder signal cable 5 connected to the printed board 3 by means of the combination of a male connector 71 and a female connector 72 is pulled out of the encoder cover 2 through a cable window 27, which is pluged by a pair of grommets 28. A potential gap remained between the grommets 28 is filled up with a sealant 29.

When the foregoing dustproof type encoder which is available in the prior art and is illustrated in FIGS. 1 and 2 is employed, the encoder signal cable 5 is required to be fixed to the encoder cover 2 and the potential gap remained between the two grommets 28 is required to be filled up with the sealant 29, before the male connector 71 connected to the printed board is connected to the female connector 72. Since this procedure can be conducted only by manual labor, a considerable amount of time and labor is required to employ the dustproof type encoder available in the prior art. In this sense, the dustproof type encoder available in the prior art is remarkably inconvenient to employ.

Further, since the encoder signal cable 5 can be readily bent, the hardened sealant 29 has a tendency to be easily removed from the gap remained between the grommets 28.

In conclusion, the dustproof type encoder available in the prior art is involved with various drawbacks particularly in the sense that the dustproof type encoder is considerably inconvenient to employ and the air-tightness thereof is not necessarily reliable.

SUMMARY OF THE INVENTION

A first object of this invention is to provide a dustproof type connector which is convenient to employ particularly in the sense that a less manual labor is required to apply the dustproof type connector to a specific location which requires dustproof structure and that the air-tightness thereof is reliable.

A second object of this invention is to provide a dustproof type encoder which is convenient to employ in the sense that a less manual labor is required to connect a cable to the dustproof type encoder and to secure the air-tightness thereof, and the air-tightness thereof is reliable. More specifically, the seond object of this invention is to provide a dustproof type encoder which is free from time consuming manual procedure to fix an encoder signal cable to an encoder cover and to fill up the gap remained between gommets with the sealant, and of which the dustproof efficiency is excellent.

To achieve the first one of the foregoing objects, a dustproof type connector in accordance with this invention comprises a male member 41 of an insulator tube, the male member 41 having a closed bottom, having a couple of male contact pins 42 extending in the direction parallel to the normal of the insulator tube and penetrating the closed bottom, and having at least one recess or projection 43 on the internal surface of the insulator tube, a female member 44 of an insulator tube of which the external diameter approximately equals to the internal diameter of the insulator tube of the male member 41, the female member 44 having a dustproof packing stopper cap 46 made of insulator and made on the top the insulator tube, having a couple of female contacts 45 which extend in the direction parallel to the normal of the insulator tube to be connected with the male contact pins 42 and which are connected with a pull-out cable which penetrates the dustproof packing stopper cap 46, having at least one projection or recess 47 on the external surface of the insulator tube to link with the projection or recess 43 of the insulator tube of the male member 41, and a dustproof packing 48 of a soft annular plate having the internal diameter which approximately equals to or is slightly larger than the external diameter of the insulator tube of the male member 41 and having the external diameter which is larger than the external diameter of the dustproof packing stopper cap 46.

To achieve the second one of the foregoing objects, a dustproof type encoder in accordance with this invention comprises an encoder flange 1 which is an encoder proper and which houses a rotating member to be rotated from outside, a printed board 3 mounted on the encoder flange 1, the foregoing dustproof type connector 4 of this invention mounted on the printed board 3, an encoder cover 2 which covers the encoder flange 1 and the printed board 3 and which has an window 22 to allow the foregoing dustproof type connector 4 to penetrate, the window being allowed to be closed with one action with which the female member 44 of the foregoing dustproof type connector 4 is fixed to the male member 41 of the foregoing dustproof type connector 4, while the dustproof packing 48 is placed between the dustproof packing stopper cap 46 of the female member 44 of the foregoing dustproof type connector 4 and the encoder cover 2.

BRIEF DESCRIPTION OF THE DRAWINGS

This invention, together with its various features and advantages, can be readily understood from the following more detailed description presented in conjunction with the following drawings, in which.

DETAILED DESCRIPTION OF THE PREFERRED EMBODIMENTS

Referring to drawings, detailed description will be presented below for a dustproof type connector in accordance with one embodiment of this invention and a dustproof type encoder in accordance with the other embodiment of this invention.

DUSTPROOF TYPE CONNECTOR

Figure 1:
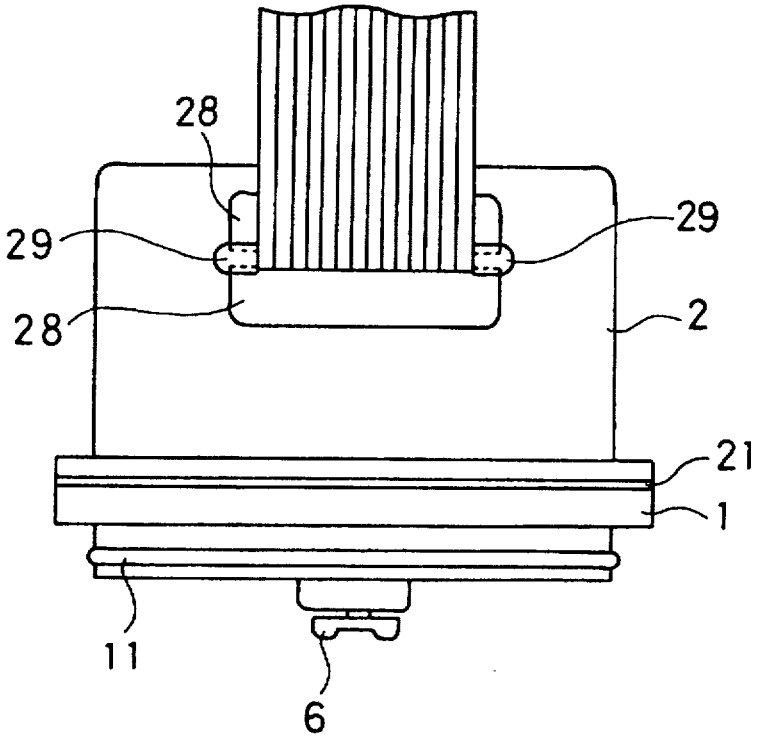
Fig. 1 PRIOR ART
FIG. 1 is a side view of an encoder which is covered by a dustproof cover and which is available in the prior art.
Figure 2:
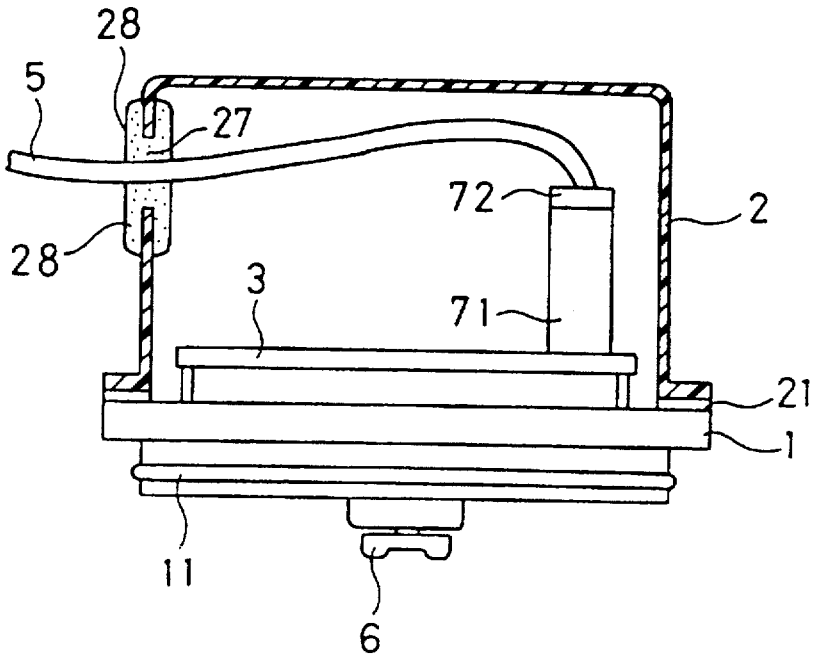
Fig. 2 PRIOR ART
FIG. 2 is a sectional front view of an encoder which is covered by a dustproof cover and which is available in the prior art.
Figure 3:
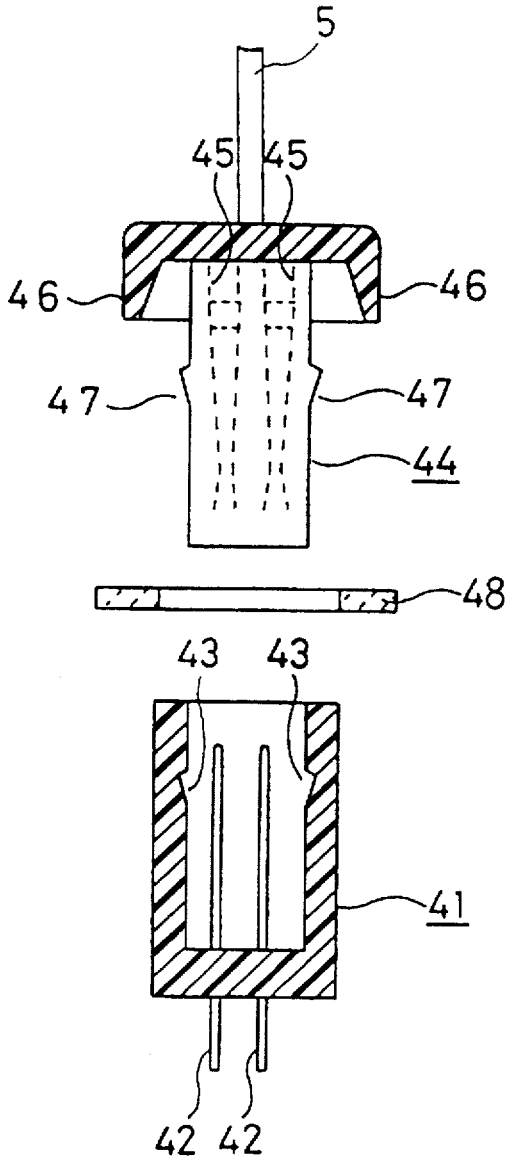
FIG. 3 is a disassembled front view of a dustproof type connector in accordance with this invention.

Referring to FIG. 3, a male member 41 is an insulator tube of which the bottom is closed. The bottom is penetrated by a couple of male contact pins 42, which extends in the direction parallel to the normal of the insulator tube. The male member 41 of the insulator tube has at least one recess or projection 43 on the internal surface thereof. A female member 44 is an insulator tube of which the top is closed by a dustproof packing stopper cap 46 which is made of insulator. The external diameter of the female member 44 approximately equals to the internal diameter of the male member 41. A couple of female contacts 45 extend downward from the dustproof packing stopper cap 46 in the direction parallel to the normal of the insulator tube to be connected with the male contact pins 42 of the male member 41. The female member 44 has at least one projection or recess 47 on the external surface of the insulator tube to link with the corresponding projection or recess 43 of the insulator tube of the male member 41.

As a result, the male member 41 and the female member 44 can be readily connected to each other with one action with which the female member 44 is inserted in the male member 41. A pull-out cable 5 is connected to the upper end of the female contacts 45 extends upward and penetrates the dustproof packing stopper cap 46.

A dustproof packing 48 of a sponge insulator annular plate has an internal diameter which approximately equal to or is slightly larger than the external diameter of the male member 41 and an external diameter which is larger than the external diameter of the dustproof packing stopper cap 46.

Accordingly, the dustproof type connector in accordance with this invention can be conveniently employed to connect conductors which are connected to the male contact pins 42 of the male member 41 and to the pull-out cable 5 which is pulled out from the female member 44, with one action with which the female member 44 is inserted into the male member 41, while the dustproof packing 48 is placed between the dustproof packing stopper cap 46 and the cover of an electronic unit such as a cubicle or the like into which the foregoing conductor is pulled out, without requiring time and labor which were required for the dustproof connector available in the prior art.

DUSTPROOF TYPE ENCODER

Figure 4:
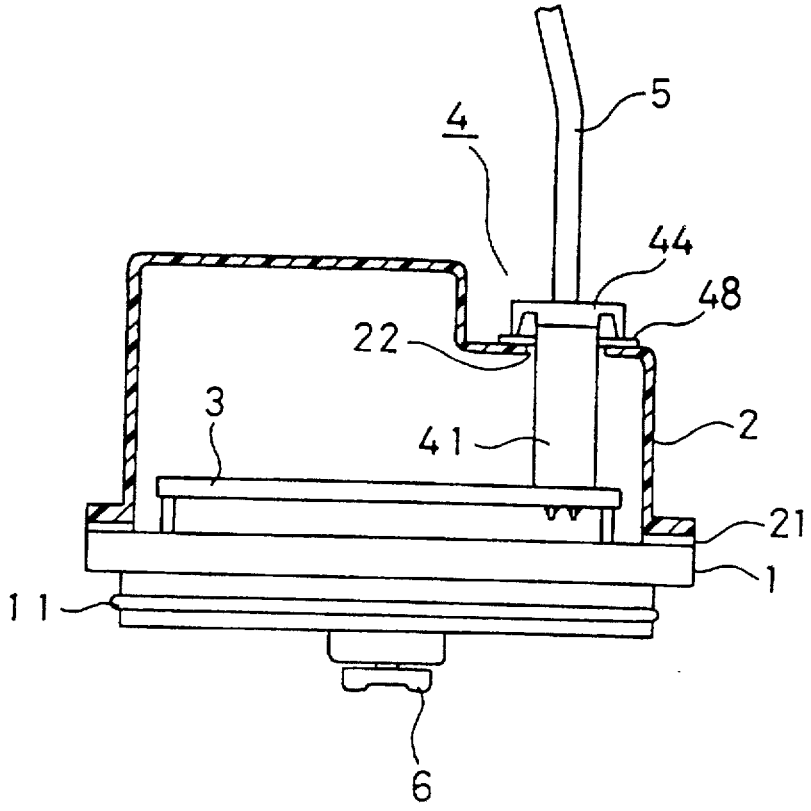
FIG. 4 is a sectional front view of a dustproof type encoder in accordance with this invention.

Referring to FIG. 4, an encoder flange 1 which is an encoder proper and which houses a rotating member to be rotated from outside through a coupling 6 is mounted by a printed board 3. One surface of the encoder flange 1 is covered by an encoder cover 2, and the other surface of the encoder flange 1 is covered by an encoder back cover (unnumbered). A cover packing 21 is provided between the encoder flange 1 and the encoder cover 2 and an O ring 11 is provided between the encoder flange 1 and the encoder back cover. A dustproof type connector 4 in accordance with this invention is mounted on the printed board 3. The dustproof type connector 4 in accordance with this invention consisting of a male member 41, a female member 44, a dustproof packing 48 and a pull out cable 5, penetrates the encoder cover 2 through a connector window 22.

Since the internal diameter of the dustproof packing 48 approximately equals or is slightly larger than the external diameter of the male member 41 and since the external diameter of the dustproof packing 48 is larger than the external diameter of the dustproof packing stopper cap 46 of the female member 44, the combination of the dustproof packing stopper cap 46 and the dustproof packing 48 effectively eliminate a potential gap between the dustproof packing stopper cap 46 and the encoder cover 2, resultantly enhancing the dustproof efficiency of the encoder 2. Incidentally, since the dustproof type connector 4 in accordance with this invention can be connected with one action in which the recess or projection 43 and the projection or recess 47 is linked, a procedure for applying the dustproof type connector 4 in accordance with this invention to the dustproof type encoder in accordance with this invention is considerably simpler, requiring less of time and manual labor. In conclusion, an action to insert the female member 44 into the male member 41 is sufficient to secure the air-tightness of the encoder in accordance with this invention.

Although this invention has been described with reference to specific embodiments, this description is not meant to be construed in a limiting sense. Various modifications of the disclosed embodiments, as well as other embodiments of this invention, will be apparent to persons skilled in the art upon reference to the description of this invention. It is therefore contemplated that the appended claims will cover any such modifications or embodiments as fall within the true scope of this invention.

What is claimed is :

1. A dustproof encoder, comprising:

a male member having a male hollow member formed of an insulator and extending in one direction, one end of the male hollow member being closed and one end being open, the male hollow member having an outer surface and an inner surface with at least one projection or recess on the inner surface, the closed end of the male member being penetrated by a pair of male contact elements extending within the male hollow member and parallel to said one direction, the male contact elements being at selected positions within the male hollow member;

a female member having a female hollow member formed of a resilient insulator and extending in a direction opposite to said one direction, the female hollow member having inner and outer surfaces, the outer surface of the female hollow member being approximately the same size as the inner surface of the male hollow member and being provided with at least one projection or recess, the female member having a stopper cap formed of an insulator and serving as a closure for one end of the female hollow member, the stopper cap surrounding a portion of the female hollow member, extending downward and having an outer surface larger than the outer surface of the female hollow member, the stopper cap being penetrated by a pair of female contact elements extending within the female hollow member and parallel to the direction opposite to said one direction, the female contact elements being at positions within the female hollow member which correspond to the selected positions of the male contact elements for releasable connection with the male contact elements;

a packing member having an opening with an inner surface which is approximately equal to or slightly larger than the outer surface of the male hollow member, and having an outer surface which is larger than the outer surface of the stopper cap and adapted to be engaged by the stopper cap;

a bottom member having a flange with a rotating member therein driven by a rotatable object;

a printed circuit board resting above the bottom member, the male member extending up from the printed circuit board at connection position; and a cover having an opening with an inner surface larger than the outer surface of the female hollow member and smaller then the outer surface of the packing member, the opening being located at a position corresponding to the connection position at which the male member extends from the printed circuit board such that when the cover is aligned with and fitted on the bottom member, at least one of the male and female members extends through the opening, whereby said dustproof encoder has dustproof characteristics caused by a combination of the flange, the packing member and the cover, and said dustproof encoder is convenient for engaging and disengaging the male member and the female member.

2. A connection mechanism according to claim 1, wherein the printed circuit board rests above a first side of the bottom member, and the rotatable member is rotatable by a piece provided on a second side of the bottom member opposite the first side above which the printed circuit board rests.

* * * * *